US006425155B1

(12) United States Patent
Carey

(10) Patent No.: US 6,425,155 B1
(45) Date of Patent: Jul. 30, 2002

(54) HAND-HELD MULTIFUNCTIONAL TOOL TO ASSIST IN DECORATING ACTIVITIES

(76) Inventor: Karl Carey, 28 Kerdiff Avenue, Naas (IE)

( * ) Notice: Subject to any disclaimer, the term of this patent is extended or adjusted under 35 U.S.C. 154(b) by 0 days.

(21) Appl. No.: 09/472,070

(22) PCT Filed: Jun. 29, 1998

(86) PCT No.: PCT/IE98/00054

§ 371 (c)(1),
(2), (4) Date: Mar. 24, 2000

(87) PCT Pub. No.: WO99/00258

PCT Pub. Date: Jan. 7, 1999

(30) Foreign Application Priority Data

Jun. 27, 1997 (IE) ..... S970481

(51) Int. Cl.[7] ..... B44C 7/00
(52) U.S. Cl. ..... 7/105; 7/163; 7/164
(58) Field of Search ..... 7/105, 158, 163, 7/164

(56) References Cited

U.S. PATENT DOCUMENTS 812,740 A * 2/1906 Harris et al. ..... 7/105
4,209,865 A * 7/1980 Kozlowski ..... 7/105
4,759,441 A * 7/1988 Leurck ..... 7/105
5,050,306 A * 9/1991 Renaud ..... 30/293

* cited by examiner

*Primary Examiner*—Joseph J. Hail, III
*Assistant Examiner*—Joni B. Danganan
(74) *Attorney, Agent, or Firm*—Pierce Atwood

(57) ABSTRACT

A hand-held tool useful for a decorator, particularly while wallpapering, comprises a substantially flat body (1) having several retaining means (2, 20, 4, 6) formed in it for holding implements such as a pencil (P), knife (K) and spirit levels (S1, S2). A pair of spirit levels (S1, S2) are retained in retaining means (2, 20) at right angles to one another to enable horizontal and vertical lines to be found. Knife (K) is retained in a groove (6) with its blade shielded to prevent it from accidentally injuring a person. The tool has a flexible edge area (12) which tapers to a straight, ruled edge **(12*b*). This area (12) is useful for pressing pasted paper onto a wall and for removing air-bubbles. Edge (12*b*), which is parallel to one spirit level (S1) and perpendicular to the other (S2), facilitates the measuring of distances between widths of wallpaper. Studs (9) are provided on a rear face of the body (1)** so that the body stands proud of a surface and can thereby be more easily grasped.

10 Claims, 3 Drawing Sheets

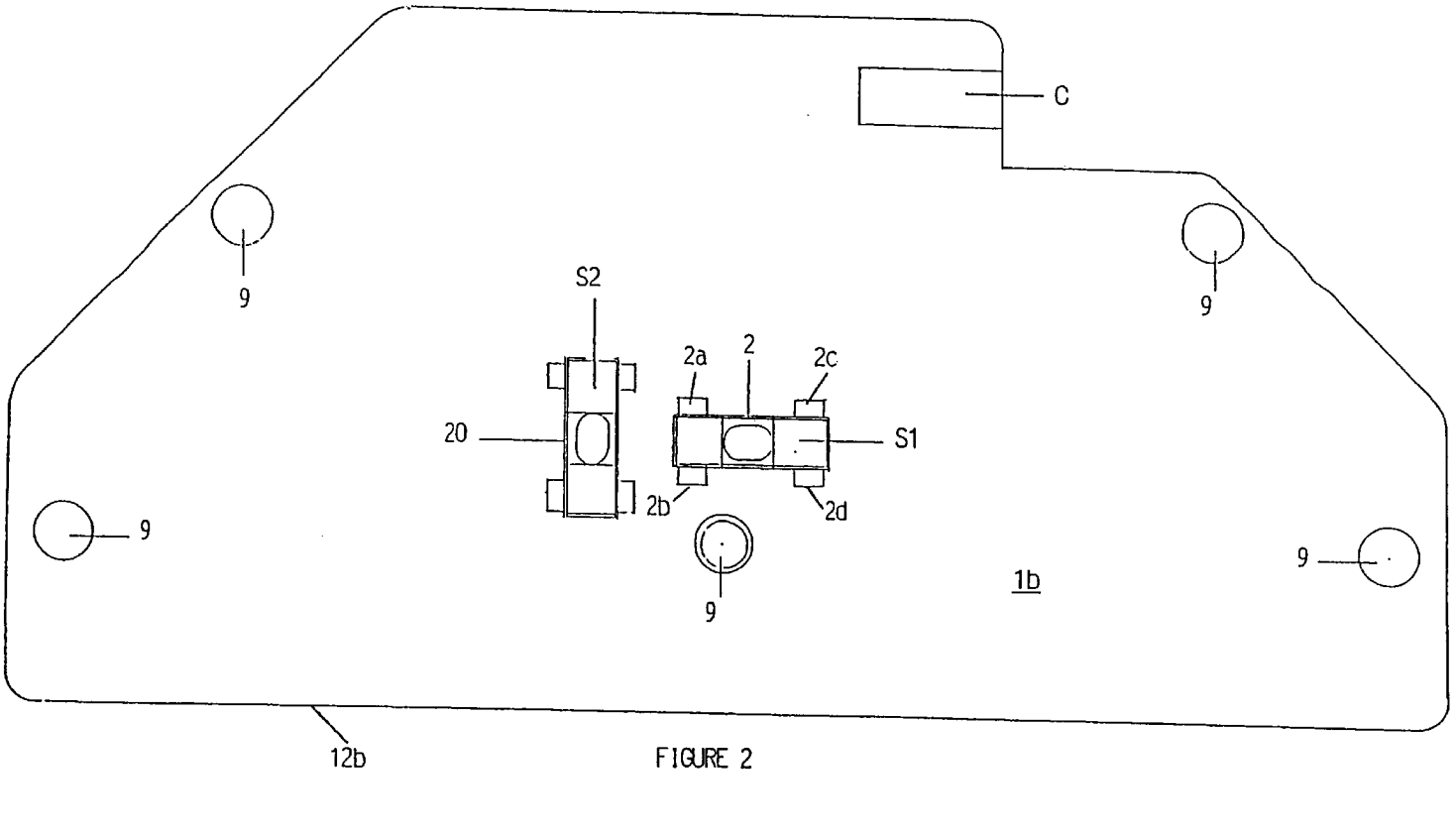
FIGURE 2
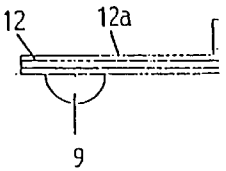

HAND-HELD MULTIFUNCTIONAL TOOL TO ASSIST IN DECORATING ACTIVITIES

The present invention relates to a tool and in particular to a tool for assisting a decorator in conducting tasks such as wallpapering, wall tiling, sign writing and the like.

Decorating works of the type mentioned above require substantial skill in order to produce a good finish. For example, wallpapering requires that the first length of paper be hung very straight so that it and subsequent lengths are vertical. Once the first length is hung properly, it is a relatively simple matter to ensure that the rest of the lengths are correctly aligned to the first one. Ensuring that each length contacts the wall properly so that bubbling, usually caused by air pockets or excess paste is avoided is another aspect of the job which requires a good degree of skill and it can be a time-consuming task to ensure that all air pockets are evacuated and the paste spread evenly before going on to hang the following length of paper.

Another difficulty which arises with wallpapering is that of obtaining neat cut edges, for example at the bottom of the lengths, around light switches, radiators, architraves, windows and so on. It is a matter of some difficulty to obtain a clean cut and to avoid any ripping or tearing of the paper.

Likewise, in the conduct of jobs such as hanging borders, picture- or dado-rails, tiles, signwriting and so on, it is very important to ensure that the border, etc., is properly positioned relative to the vertical and horizontal.

The present invention seeks to provide a versatile tool which is useful to a decorator in many aspects of the tasks he or she conducts, and is particularly helpful for wallpapering.

Accordingly, the present invention provides a decorator's tool comprising a substantially flat, hand-holdable device, the device having a body including:

- a flexible spreading region for a) pressing a pasted surface covering material to a wall,
- b) distributing the paste evenly between the pasted surface and the wall and c) removing air or excess paste from between the pasted surface and the wall;
- a straight edge;
- means for retaining a pair of levelling devices respectively horizontal and parallel to the straight edge;
- retaining means for removably receiving a marking implement; and
- fixing means for removably engaging a cutting, implement.

Preferably, the retaining means and the fixing means are provided on a front side of the body. Advantageously, the means for retaining the levelling devices are arranged in the body such that the levelling devices retained thereon are viewable from the front and rear sides of the body.

In a preferred arrangement, the fixing means includes guard means for surrounding a cutting edge of a cutting implement when mounted on the body to prevent the cutting edge from inadvertently causing injury to a user. The fixing means may comprise a groove for receiving the cutting implement and the groove may include engaging means for retaining the cutting implement. In addition, the fixing means may include formations engageable with complementary formations of the cutting implement for retaining the cutting implement in engagement with the body.

The retaining means conveniently comprises a track sized to receive a marking means such as a pencil and means for releasably holding the marking means in the track. The holding means may comprise a pair of opposed tabs biased toward one another and capable of receiving the marking means between them by push-fit. In a preferred arrangement, a plurality of such holding means are provided, spaced along the length of the track.

The straight edge is conveniently provided with ruler markings for enabling a user to measure distances. In a preferred arrangement, the straight edge is provided at the edge of the spreading region and the spreading region is formed integrally with the device as a surface thereof which extends from the body of the device and tapers toward the straight edge. The straight edge may be used to facilitate the user in the drawing of straight guidelines or as a guide for making straight cuts in the covering material.

Conveniently, the rear side of the body includes at least one stud member spaced from the rear surface for elevating the rear surface clear of any support surface against which the rear side of the device is rested in use.

Whilst the spreading region should have some degree of flexibility, it need not be of a soft or rubbery consistency and a good degree of rigidity is preferred to ensure that the edge can be placed definitely into corners and the like. In a preferred arrangement, the tool is sized to fit into a pocket, such as a back pocket of overalls or jeans so that it can easily be reached for and found as and when it is needed. It is also advantageous that the tool be made of a brightly coloured material, such as brightly coloured plastics material so that the tool is highly visible and can readily be found if left on a surface. A considerable amount of time can be lost by a decorator when he or she places tools down, as they can readily become buried under paper cut-offs and other materials. In addition to combining all the necessary implements into one handy tool, the present invention provides a tool which is sized to fit into a pocket of the decorator's clothing so that it is always conveniently to hand when needed. Even if it is put down, its bright coloration makes it easy to see so that it can be retrieved readily.

The invention will now be described more particularly with reference to the accompanying drawings, which show, by way of example only, one embodiment of a decorator's tool according to the invention. In the drawings:

FIG. 2 is a plan view of the rear face of the tool;

Figure 1:
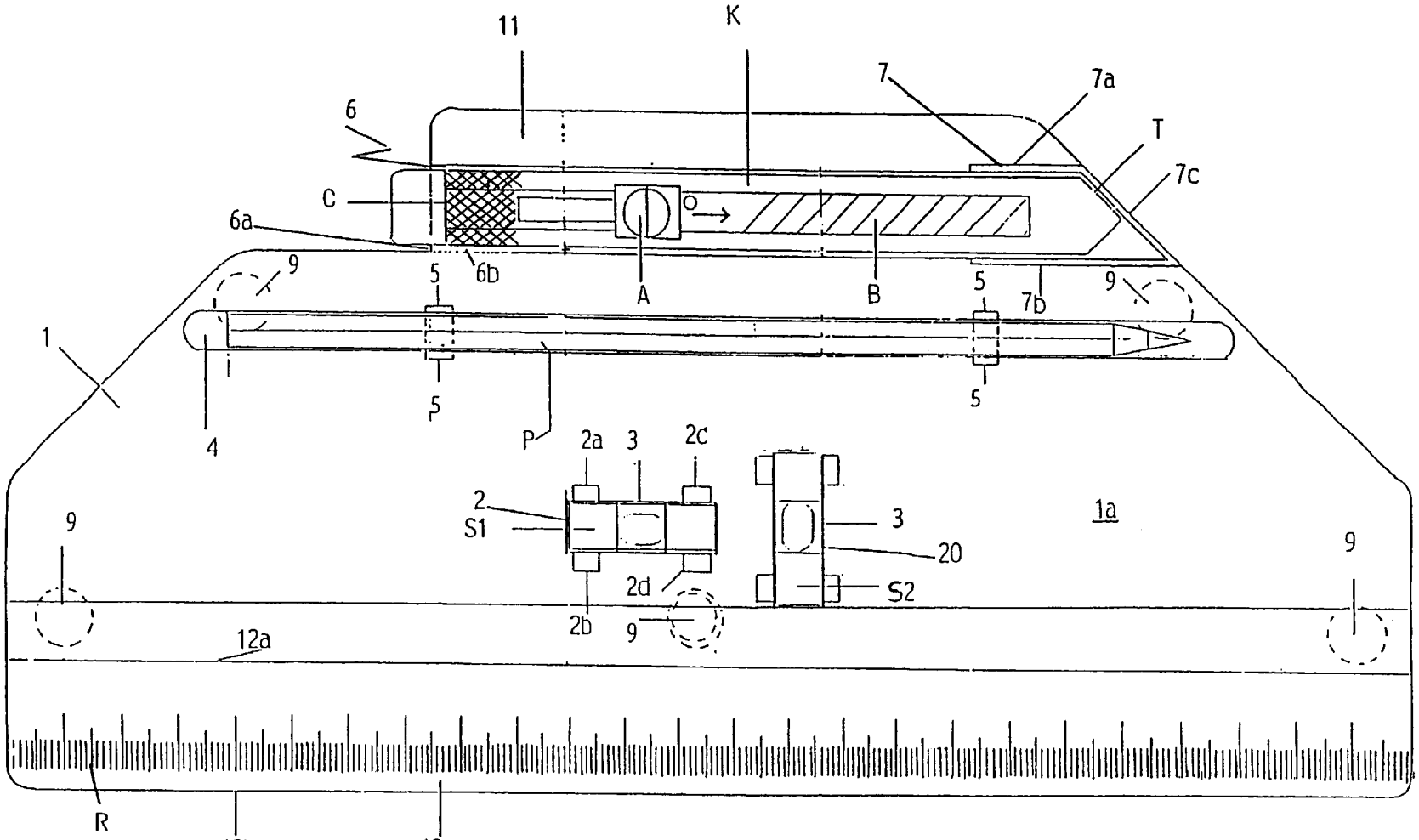
FIG. 1 is a plan view of the front face of a tool in accordance with the invention.
Figure 3:
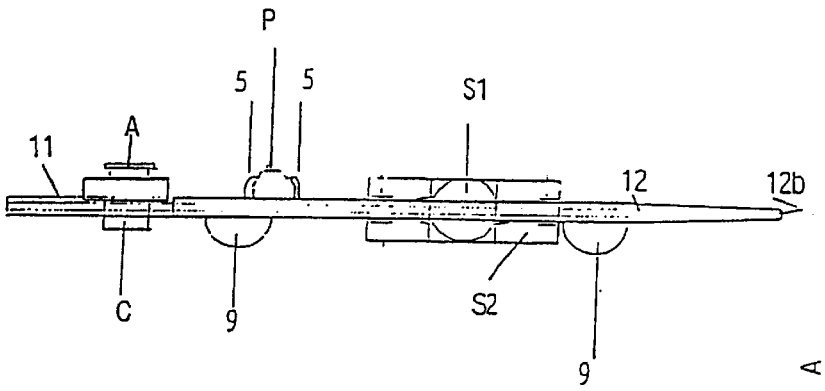
FIG. 3 is a left side elevational view of FIG. 1.
Figure 4:
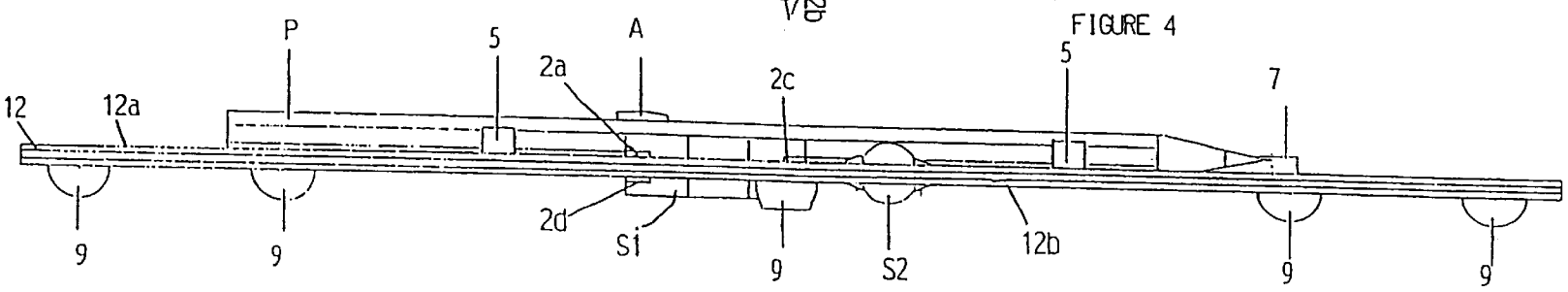
FIG. 4 is a bottom side elevational view of FIG. 1.

Referring now to the drawings, the tool comprises a substantially flat hand held tool body 1 having several sets of retaining means for holding implements which are commonly used by a decorator. Retaining means 2 is adapted to hold a spirit level S1 and comprises a pair of grips (2*a*, 2*b*), (2*c*, 2*d*) disposed in the walls of a slot 3. Each pair of grips (2*a*, 2*b*) or (2*c*,2*d*) has a concave surface which engages with and retains the convex surface of the spirit level S1 in the slot 3 between them. A second similar retaining means 20 is disposed at right angles to retaining means 2 for holding a second spirit level S2 and to enable the tool to be used for finding the vertical and the horizontal at the same time. The spirit levels S1 and S2 are held in the retaining means 2, 20 as snap-fits, but may alternatively be fixed therein by any other suitable fixing means including adhesive. The spirit levels S1 and S2 are held in the body 1 so that they are spaced from both the front (1*a*) and the rear (1*b*) faces of the body.

A track 4 is provided on the front face 1*a* of the tool 1 and is sized and shaped to receive a marker means such as a pencil P. Pairs of opposed tabs 5 are disposed at intervals along the length of the track 4 and are biased toward one another for retaining between them the pencil P as a snap-fit. Most preferably, at least two sets of tabs 5 are provided so that the pencil P may still be retained by at least two pairs of tabs spaced along the length of the track, even as it is used and pared down to shorter lengths.

Adjacent that end 11 of the tool 1 which in use is held in the hand is disposed a groove 6 adapted to receive and retain a snap-off bladed knife K. As with track 4, groove 6 may include tabs (not shown) for retaining the knife in the groove 6. The groove 6 also includes a guard 7 which closes off the end of the groove 6 at which the blade end of the knife K is housed. Guard 7 has two spaced apart parallel walls 7*a*, 7*b* connected by a slanted wall 7*c*.

Walls 7*a*, 7*b*, 7*c* are spaced from the planar surface of the front face 1*a* of the tool 1. As is common with such knives, knife K includes a reusable, scored blade B which is advanced to the tip T of knife K by sliding the knob A in the direction of the arrow. The blade B can be used for cutting when it emerges beyond the tip T of the knife K. The knife K is introduced into the groove 6 by sliding it from the open end 6*a* of the groove 6, and along the groove 6, tip T leading, until the tip T containing the blade B impinges against guard wall 7*c* and comes to rest against the guard 7. Thus, even if the blade B is extended, the guard 7 serves to protect the user from being accidentally cut by the blade B, provided that the blade B has not been locked in its extended position. If the blade B is locked in the extended position, the guard 7 will shield the user from being cut by it.

Furthermore, even if the blade B has been left in an extruded position, as the knife K moves into place in the groove 6, the abutment between the blade B and the guard wall 7*c* causes the blade B to be retracted into the knife K. The travel of the knife K in the groove 6 can also be limited by the choice of a knife K which is provided with a clip C at its end distal the tip T. The clip C is of the type commonly provided on pens to enable them to be attached to the breast pocket. The clip C passes along the rear side of the base 6*b* of the groove 6 and when the base of the clip C abuts the free end 6*a* of the groove, further travel of the knife 6 is prevented and the knife 6 is retained in the front side of the base 6*b* of the groove 6 by the biasing of the clip C toward the body of the knife K, thus clamping the knife K to the base 6*b* of the groove 6. The location of the clip with the groove 6 may be enhanced by the provision of knurling (not shown) on the rear face 1*b* of the tool 1 which is complementary to knurling provided on the clip C so that the sets of knurled formations nest together to retain the parts in more secure engagement.

The area 12 of the tool 1 tapers from the line 12*a* to the straight edge 12*b* and is fabricated from a material which has some flexibility. This area is provided with measurements along its length, either in metric or imperial units, or both. Edge 12*b* is parallel to the longitudinal axis of spirit level S1 and perpendicular to the longitudinal axis of spirit level S2.

Finally, studs 9 are provided on the rear face of the tool 1. One function of the studs 9 is to assist the user in picking the tool 1 up, as they cause it to be spaced from a surface. Another function which they serve is to protect the spirit levels S1 and S2, as these extend slightly beyond the rear side of the tool 1 and could be broken were the tool to be dropped on that side. The studs 9 stand further beyond the rear face than do the spirit levels S1 and S2 and therefore protect the levels from shattering if the tool is dropped onto its rear face.

The use of the tool will now be described with particular reference to wallpapering activity.

The first step is to mark the wall with a vertical line to define a line with which one of the longitudinal edges of the first length of paper is to be aligned. This is done by holding the tool in the hand, with its rear face facing the wall and with the edge 12*b* disposed vertically. The position of the tool is altered slightly until spirit level S2 indicates that the edge 12*b* is vertical. Holding the tool 1 in that position, the user then removes the pencil P from its track 4 and draws a line on the wall using the edge 12*b* as a guide. The studs 9 assist in keeping all parts of the tool 1, with the exception of the part of area 12 closest to the edge 12*b*, clear of the wall and thus assist the user in retaining hold of the tool 1 and in sliding the tool upwardly and/or downwardly to elongate the line.

A length of wallpaper is then cut, pasted and fitted to the wall using the pre-drawn vertical line as a guide. The length can then be smoothed down onto the wall using the flexible edge 12*b* of the tool as a spreader to press the paper into contact with the wall, to even out the paste and to move any air bubbles or excess paste from between the wallpaper and the wall.

Once the length is hung, it can be trimmed top and bottom using tie knife K. The knife K is withdrawn from its groove 6 and the blade B is advanced clear of the tip T. Next, the straight edge 12*b* is aligned horizontally against the wallpaper with the wallpaper to be trimmed off extending away from the edge 12*b*. Spirit level S1 can be used to ensure that the edge 12*b* is properly aligned horizontally. Using the blade B, the paper is then cut, to give a clean, neat finish to the paper. The bevelling or tapering of the area 12 toward the straight edge 12*b* assists the user in obtaining a clean cut, as it rests against the wallpaper which is to remain on the wall, protecting it from being dragged or tom as the blade B is drawn across. Once the cut has been made, the blade B is retracted and the knife K is replaced in the groove 6. Should the user forget to retract the blade B, then the guard 7 will cause the blade B to be retracted, in the manner described above, as the knife K is pressed home in the groove 6.

It is convenient to hang the first length of wallpaper bordering a corner and to assist in this, the rulings R provided adjacent the edge 12*b* enable the user to mark the first guideline at a distance spaced from the corner by the width of the wallpaper. Typically, this width is 520 mm. In a preferred arrangement, the width of the edge 12*b* is 250 mm, and the user can therefore nest the tool 1 into the corner, with the edge 12*b* horizontal. The tool is then slid sideways by two distances of the edge 12*b*, plus an additional 20 mm and the guideline is drawn at that point.

Thus, the user has at hand at all times and in a convenient presentation, the various implements needed to carry out the work. It will be appreciated that the tool is of great assistance for aspects of wallpapering which are generally considered awkward and tedious, for example fitting the paper about light switches or sockets or into window reveals, as it includes a knife, pencil, straight edge, ruler and levelling aids, all neatly presented in one tool. In addition, it includes a handy spreader which enables the user to obtain a good smooth finish with a superior distribution of paste over the pasted surface of the wallpaper. Since the spreading edge 12*b* enables paste to be efficiently distributed on the paper in an even fashion, less paste may be needed than would otherwise be the case, therefore the paste dries faster and the final surface achieved after the paste has dried is even and smooth.

The tool 1 is equally useful for tasks such as hanging borders or tiles. In either case, the levelling aids enable the user to ensure that correct horizontal and vertical alignments are obtained and the ruler provided on the area 12 adjacent the edge 12*b* is of assistance in marking distances. This combination of features also makes the tool 1 useful to a signwriter. It will be appreciated therefore, that the tool 1 is equally useful to the professional decorator and to the do-it-yourself user. It provides a combination tool which is multifunctional and which assists the user in completing the task efficiently, as the necessary implements are to hand at all times in a single tool and the user can avoid the frustrations and delays caused by mislaying the various implements when these are provided separately.

The dimensions of the tool 1 may be chosen as required. One particular advantageous set of dimensions is where the distance between the edges 11 and 12*b* is 100 mm and the length of the edge 12*b* as 250 mm. This size is useful as it is a good size for holding and working and small enough to fit in a pocket so that the user can have the tool to hand at all times whilst the job is being done.

Most advantageously, the tool is formed without rough or sharp edges which might snag or catch the wallpaper, causing it to tear. In a preferred arrangement therefore, the edges of the tool will be rounded and/or chamfered.

It will of course be understood that the invention is not limited to the specific details described herein, which are given by way of example only, and that various modifications and alterations are possible within the scope of the invention, as defined in the appended claims.

What is claimed is:

1. A decorator's tool comprising a substantially flat, hand-holdable device, the device having a body (1) including:

a unitary flexible spreading region (12) for a) pressing a pasted surface covering material to a wall, b) distributing the paste evenly between the pasted surface and the wall and c) removing air or excess paste from between the pasted surface and the wall;

a straight edge (12*b*);

a pair of levelling devices (S1,S2), a marking implement (P), and a cutting implement (K);

means (2,20) for retaining the pair of levelling devices (S1,S2) respectively perpendicular and parallel to the straight edge;

grip means (4) for removably receiving the marking implement (P); and fixing means (6) for removably engaging the cutting implement (K), wherein the fixing means (6) includes formations engageable with complementary formations of the cutting implement (K) for retaining the cutting implement (K) in engagement with the body (1).

2. A tool according to claim 1, in which the grip means (4) and the fixing means (6) are provided on a front side of the body and the means (2,20) for retaining the levelling devices (S1, S2) are arranged in the body (1) such that the levelling devices retained thereon are viewable from the front and rear sides of the body.

3. A tool according to claim 1, in which the fixing means includes guard means (7) for surrounding a cutting edge of a cutting implement when mounted on the body to prevent the cutting edge from inadvertently causing injury to a user.

4. A tool according to claim 3, in which the fixing means comprises a groove (6) for receiving the cutting implement and the groove includes engaging means for retaining the cutting implement.

5. A tool according to claim 1, in which the grip means comprises a track (4) sized to receive the marking implement (P) and means (5) for releasably holding the marking implement (P) in the track.

6. A tool according to claim 5, in which the holding means comprises a pair of opposed tabs (5) biased toward one another and capable of receiving the marking means between them by push-fit.

7. A tool according to claim 1, in which the straight edge (12*b*) is provided with ruler markings (R) for enabling a user to measure distances.

8. A tool according to claim 1, in which the straight edge is provided at the edge of the spreading region and the spreading region is formed integrally with the device as a surface thereof which extends from the body of the device and tapers toward the straight edge.

9. A tool according to claim 1, in which the rear side of the body includes at least one stud member (9) spaced from of the rear surface for elevating the rear surface clear of any support surface against which the rear side of the device is rested in use.

10. A tool according to claim 1, in which the body is fabricated from a brightly coloured plastic material.

* * * * *